US006234437B1

(12) United States Patent
Cabo

(10) Patent No.: US 6,234,437 B1
(45) Date of Patent: May 22, 2001

(54) FLEXIBLE SUPPORT

(76) Inventor: Ricardo F. Cabo, P.O. Box 430754, San Diego, CA (US) 92143

( * ) Notice: Subject to any disclaimer, the term of this patent is extended or adjusted under 35 U.S.C. 154(b) by 0 days.

(21) Appl. No.: 09/328,900

(22) Filed: Jun. 9, 1999

(51) Int. Cl.[7] ..... E01F 15/00
(52) U.S. Cl. ..... 248/220.22; 248/200; 256/13.1
(58) Field of Search ..... 256/13.1, 65; 248/200, 248/66, 560, 592, 71, 220.22, 222.14, 301, 300, 220.21, 316.8; 40/612; 404/10, 9, 6

(56) References Cited

U.S. PATENT DOCUMENTS

| | | | | |
|---|---|---|---|---|
| Re. 18,848 | * | 5/1933 | Moore | 256/13.1 |
| 1,953,207 | * | 4/1934 | Woods, Jr. | 256/13.1 |
| 1,977,286 | * | 10/1934 | Miller | 256/13.1 |
| 2,030,782 | * | 2/1936 | Dennebaum | 256/13.1 |
| 2,204,558 | * | 6/1940 | Ahles | 256/13.1 |
| 2,228,652 | * | 1/1941 | Dailey | 256/13.1 |
| 2,979,307 | * | 4/1961 | Crone | 256/13.1 |
| 3,077,339 | * | 2/1963 | White | 256/13.1 |
| 3,438,611 | * | 4/1969 | Giavotto et al. | 256/13.1 |
| 5,044,609 | | 9/1991 | Cicinnati et al. | 256/13.1 |
| 5,286,137 | * | 2/1994 | Cicinnati et al. | 256/13.1 |

* cited by examiner

*Primary Examiner*—Leslie A. Braun
*Assistant Examiner*—Jon Szumny
(74) *Attorney, Agent, or Firm*—Jagtiani & Associates

(57) ABSTRACT

Flexible reclining, thrusting and vertical supports for structures such as guard rail barriers. The design of the flexible supports allow them to absorb the kinetic energy of vehicles and other objects which collide with the guard rail barrier.

23 Claims, 4 Drawing Sheets

FLEXIBLE SUPPORT

RELATED FOREIGN APPLICATION

The present application claims the priority of Mexican Application No. 9806683 filed Aug. 18, 1998, the entire contents of which is hereby incorporated by reference.

BACKGROUND OF THE INVENTION

1. Field of the Invention

The present invention relates to supports of the type used in guard rails installed on the side of roads and freeways.

2. Description of the Prior Art

Metallic fences or guard rail barriers installed on the side of the roads and freeways are typically held on supports made of reinforced concrete, wood or metal. The metal supports have structural shapes ("I" beam, "C" channel, "U" shape, rolled steel section, round or square tubular, etc.) that make the supports relatively rigid. Therefore, when a vehicle collides with a conventional guard rail barrier, the support's lack of flexibility is likely to cause the support to break or to cause the support to do extensive damage to the vehicle and injury to the vehicle's occupants. Usually guard rail barrier is so damaged that it is beyond repair, so the guard rail barrier has to be replaced.

SUMMARY OF THE INVENTION

Therefore, it is an object of the present invention to provide a guard rail barrier support that is flexible and permits the absorption of the kinetic energy produced by the impact of a vehicle against the guard rail barrier to prevent a vehicle from being damaged or flipping over.

It is a further object of the present invention to provide a flexible support for a guard rail barrier that absorbs the kinetic energy of a vehicle that collides with the guard rail barrier, thereby increasing the safety of the passengers in the vehicle.

It is yet a further object of the present invention to provide a flexible support for a guard rail barrier which will not need to be replaced every time there is a collision with the guard rail barrier.

In a first aspect, the present invention provides a flexible support comprising: at least one S-shaped support, the S-shaped support including: a substantially horizontal support anchoring portion; a reclining portion connected to the support anchoring portion by a first connecting portion, the reclining portion extending at a acute angle from the support anchoring portion; and a rail mounting portion for mounting a guard rail barrier on the flexible support, the rail mounting portion being connected to the reclining portion by a second connecting portion, the rail mounting portion extending in a substantially vertical direction and facing the reclining portion.

In a second aspect, the present invention provides a flexible support comprising: at least one thrusting L-shaped support, the L-shaped support including: a substantially horizontal support anchoring portion; a thrusting portion connected to the support anchoring portion by a first connecting portion, the thrusting portion extending at a acute angle from the support anchoring portion; and a rail mounting portion for mounting a guard rail barrier on the support, the rail mounting portion extending in a vertical direction from a top part of the thrusting portion and being connected to the thrusting portion by a second connecting portion.

In a third aspect, the present invention provides a flexible support comprising: at least one inverted U-shaped support, the inverted U-shaped support including: a substantially horizontal first support anchoring portion; a first thrusting portion connected to the first support anchoring portion by a first lower connecting portion, the first thrusting portion extending at a acute angle from the first support anchoring portion; a substantially horizontal second support anchoring portion; a second thrusting portion connected to the second support anchoring portion by a second lower connecting portion, the second thrusting portion extending at a acute angle from the support anchoring portion, the second thrusting portion facing and reclining away from the first thrusting portion; a first top part on the first thrusting portion for mounting a first guard rail barrier on the support; a second top part on the second thrusting portion for mounting a second guard rail barrier on the support; and a top member connecting the first top part and the second top part.

In a fourth aspect, the present invention provides a flexible support comprising: at least one inverted J-shaped support, the inverted J-shaped support including: a vertical portion; a rail mounting portion for mounting a guard rail barrier on the support, the rail mounting portion connected to the vertical portion by a connecting portion, the rail mounting portion extending in a substantially vertical direction and facing the vertical portion.

Other objects and features of the present invention will be apparent from the following detailed description of the preferred embodiments of the invention.

BRIEF DESCRIPTION OF THE DRAWINGS

The invention will be described in conjunction with the accompanying drawings, in which.

DETAILED DESCRIPTION OF THE PREFERRED EMBODIMENT

Definitions

Figure 1:
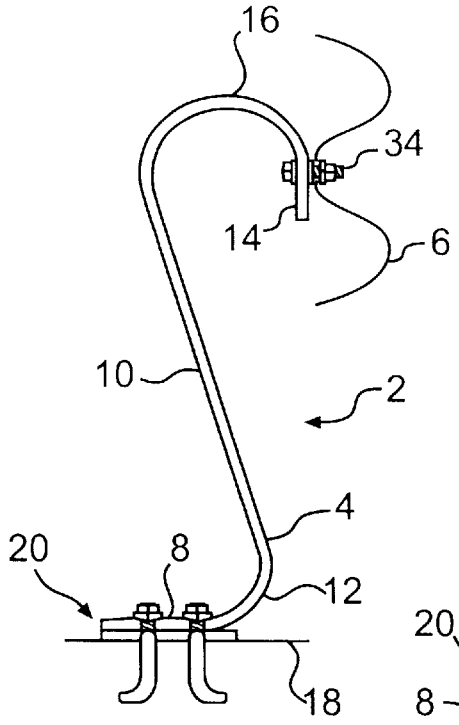
FIG. 1 is a cross-sectional side view of a a preferred embodiment a flexible support and guard rail barrier of the present invention; anchored to a red to a horizontal surface.
Figure 7:
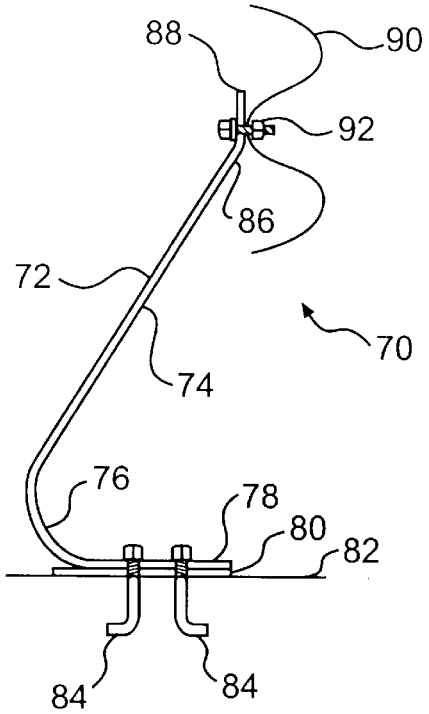
FIG. 7 is a cross-sectional side view of a another preferred embodiment of a flexible support and guard rail barrier of the present invention anchored to a horizontal surface.
Figure 8:
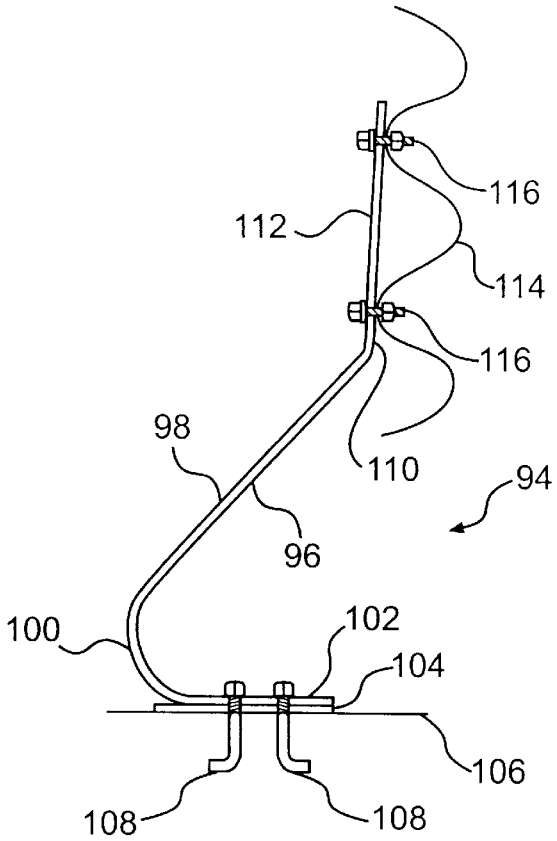
FIG. 8 is a cross-sectional side view of a another preferred embodiment of the flexible support and guard rail barrier of the present invention anchored to a horizontal surface.
Figure 9:
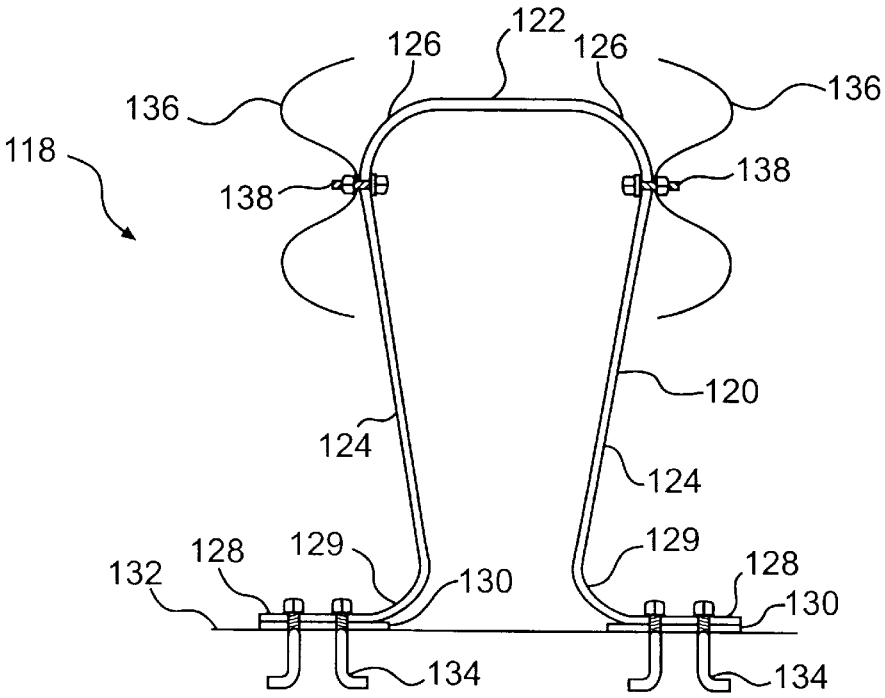
FIG. 9 is a cross-sectional side view of a another preferred embodiment of a flexible support and guard rail barrier of the present invention anchored to a horizontal surface.

For the purposes of the present invention, the term "reclining portion" refers to a portion of a flexible support which is angled away from a guard rail barrier mounted on the flexible support. An example of such a reclining portion is shown in FIG. 1. For the purposes of the present invention, the term "thrusting portion" refers to a portion of a flexible support which is angled toward a guard rail barrier mounted on the flexible support. Examples of thrusting portions are shown in FIGS. 7, 8, and 9.

Description

FIG. 1 illustrates a flexible support structure 2 made according to the present invention. Flexible support structure 2 includes an S-shaped support 4 having a longitudinal axis therethrough on which is mounted a W-shaped guard rail barrier 6. Support 4 includes a horizontal anchoring portion 8 connected to a reclining main vertical portion 10 by a lower connecting portion 12 which is preferably curved. A rail mounting portion 14 is connected to reclining main vertical portion 10 by an upper connecting portion 16, which is preferably curved. Although guard rail barrier 6 is only shown being supported by a single support 4, in many applications, such as roadside barriers, two or more supports may be used to support a given section of guard rail.

Figure 2:
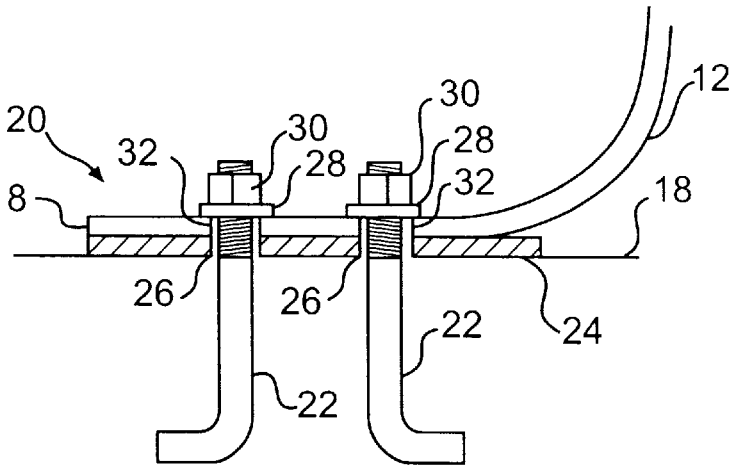
FIG. 2 is a cross-sectional side view of part of the preferred embodiment of the flexible support of FIG. 1 anchored to a horizontal surface anchored to a horizontal surface.

Support 4 is mounted on a horizontal surface 18, such as an asphalt road, a concrete highway or the ground, by an anchoring assembly 20 which anchors horizontal support anchoring portion 8 of support 4 to horizontal surface 18. As shown in FIG. 2, anchoring assembly 20 includes two anchoring screws 22 which extend through a mounting mat 24 having two openings 26. Anchoring assembly 20 also includes two lock washers 28 and two hexagonal nuts 30. Screws 22 also extend through two openings 32 in anchoring portion 8 of support 4. In some applications, anchoring screws 22 are embedded in concrete and mounting mat 24 and support are mounted over screws 22. Mounting mat 24 is preferably made of rubber or a rubber-like material such as neoprene. The mounting mat serves at least three functions: to flatten the region to which the support is anchored, to absorb part of the kinetic energy of a collision with the guard rail barrier, and to avoid cathodic corrosion of the support. Although the support shown in FIG. 1 is shown being anchored by an anchoring assembly having nuts and screws, the support of the present invention can be anchored to the ground or a roadway using a variety of means such as welding or bolting the support to a platform which is in turn anchored to the ground. The anchoring portion of the support may also be buried in the ground to anchor the support. Preferably, the support of the present invention is anchored by at least two anchoring devices, such as two or more screws, bolts, etc., to allow for kinetic energy to be absorbed by the successive pulling out of each anchoring device in the event of particularly severe collision.

Figure 3:
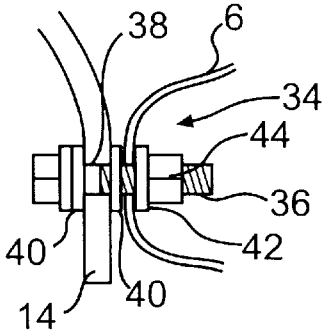
FIG. 3 is a cross-sectional side view of part of the preferred embodiment of the flexible support and guard rail barrier of FIG. 1 anchored to a horizontal surface.

As shown in FIG. 1 and in greater detail in FIG. 3, guard rail barrier 6 is mounted on the descending rail mounting portion 14 of support 4 by means of a rail mounting assembly 34 consisting of a screw 36 which extends through a opening 38 in rail mounting portion 14, two washers 40, preferably made of plastic, one lock washer 42 and an hexagonal nut 44. Guard rail barrier 6 may also be mounted on support 4 by other conventional means such as welding, bolting, etc. Guard rail barrier 6 is similar to conventional guard rail barriers and may be made from a long strip of metal or other resilient material such as plastic.

Figure 4:
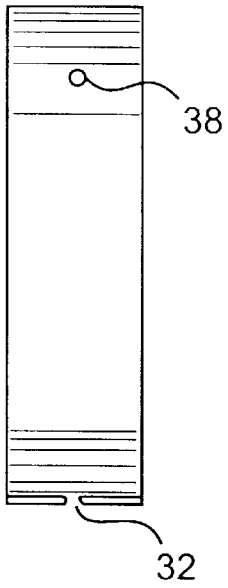
FIG. 4 is a front view of the preferred embodiment of the flexible support of FIG. 1.
Figure 5:
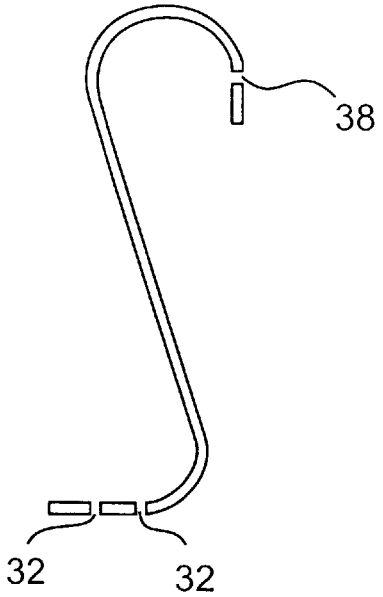
FIG. 5 is a cross-sectional side view of the preferred embodiment of the flexible support of FIG. 4.

Support 4 in FIG. 1 is further illustrated in FIGS. 4 and 5 which show in detail openings 32 in anchoring portion and openings 38 in rail mounting portion of support 4. In the embodiment shown in FIG. 4, flexible support 4 has a greater height than width. However, in some applications, it can be desirable to have a flexible support which has a greater width than height to give greater support to the guard rail barrier along the length of the guard rail barrier. The flexible support can be made of metal, plastic, metal reinforced plastic or other resilient material.

As shown in FIG. 1, flexible support 4 has a reclining main vertical portion 10 which is angled at an acute angle with respect to horizontal anchoring portion 8. Together, reclining main vertical portion 10, horizontal anchoring portion 8, and curved lower connecting portion 12 act as a spring so that when a car or other object strikes guard rail barrier 6, flexible support 4 can bend back under the pressure of the impact, and, if the impact is not too great, even spring back to the original condition of flexible support 4. By bending back under an impact, the guard rail barrier of the present invention can absorb some of the kinetic energy of a car which collides with the barrier and cause less damage to the car and less injury to the car's occupants than a conventional rigid barrier would. Also, because the guard rail barrier of the present invention will flex during a collision, there is a decreased possibility that a car colliding with the guard rail barrier will flip over or leave the road.

Because reclining main vertical portion 10 is angled away from guard rail barrier 6 in flexible support 2 of FIG. 1, reclining main vertical portion 10 is considered to be in a reclining configuration for the purposes of the present invention. Additionally, because of the reclining configuration of reclining main vertical portion 10 and the fact that rail mounting portion 14 is connected to reclining main vertical portion 10 by a curved upper connecting portion 16, rail mounting portion 14 can bend back, like a spring, towards the facing reclining main vertical portion 10 when guard rail barrier 6 is struck by a vehicle or other object. Although upper connecting portion 16 connecting reclining main vertical portion 10 and rail mounting portion 14 shown in FIG. 1 is curved, and semicircular in shape, the upper connecting portion of the present invention may be more oval in shape or even rectangular. Preferably the upper connecting portion connecting the main vertical portion and the rail mounting portion is a shape which allows the rail mounting portion to bend back toward the main vertical portion.

Figure 6:
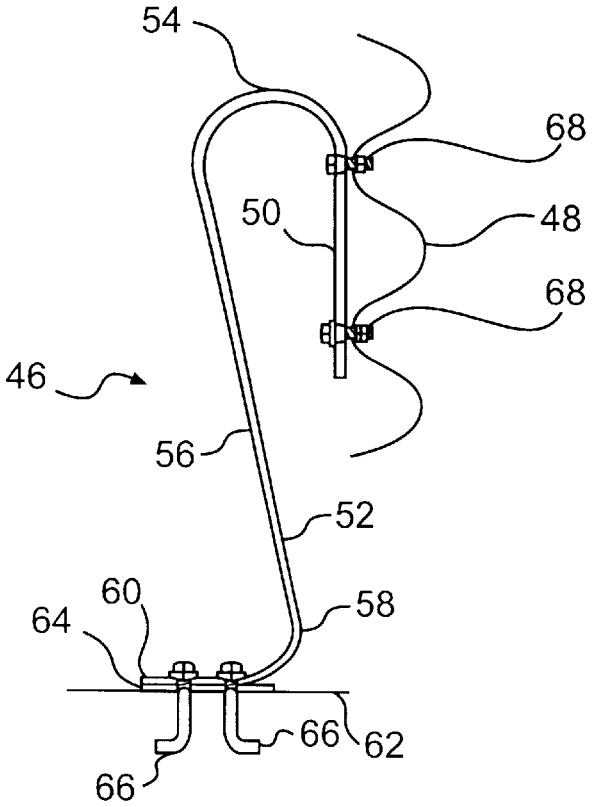
FIG. 6 is across-sectional side view of a preferred embodiment of the flexible support and guard rail barrier of the present invention anchored to a horizontal surface.

FIG. 6 illustrates a flexible support structure 46 of the present invention in which a guard rail barrier 48 having a three peaked wave-shaped cross section is mounted on a rail mounting portion 50 of an S-shaped support 52. Rail mounting portion 50 is connected by a curved upper connecting portion 54 to a reclining main vertical portion 56. Main vertical portion 56 is connected by a curved lower connecting portion 58 to a horizontal support anchoring portion 60. Support anchoring portion 60 is anchored to a horizontal surface 62 covered by a mounting mat 64 by an anchoring assembly 66 which is similar to the anchoring assembly shown in FIG. 1. Guard rail barrier 48 is mounted on rail mounting portion 50 of support 52 by means of two conventional mounting assemblies 68 which are each similar to the rail mounting assembly of FIG. 1. The greater length of rail mounting portion 50 of support 52 and the greater height of guard rail barrier 48 of flexible support structure 46, as shown in FIG. 6, allows for more force to be absorbed by flexible support structure 46 when rail mounting portion 50 bends back towards main vertical portion 56. Although guard rail barriers having only two types of cross-sections are shown in FIGS. 1 and 6, the guard rail barrier of the present invention can have any conventional guard rail barrier cross-section shape, including a flat shape. Also, although the guard rail barrier shown is preferably made out of metal, the guard rail can also be made from metal reinforced plastic, metal reinforced rubber, plastic, rubber, or any other resilient material.

FIG. 7 illustrates a flexible support structure 70 of the present invention having a thrusting L-shaped support 72. Thrusting L-shaped support 72 includes a thrusting main vertical portion 74 connected by a lower connecting portion 76 to a horizontal support anchoring portion 78. Support anchoring portion 78 is anchored to a mounting mat 80 and horizontal surface 82 by two anchoring assemblies 84 which are each similar to the anchoring assembly shown in FIG. 1. Connected to and extending from the top of thrusting main vertical portion 74 by an upper connecting portion 86 is a vertical rail mounting portion 88. A W-shaped guard rail barrier 90 is mounted on rail mounting portion 88 by means of a conventional rail mounting assembly 92 which is similar to the rail mounting assembly of FIG. 1. In flexible support structure 70 shown in FIG. 7, thrusting main vertical portion 74 is a thrusting portion because thrusting main vertical portion 74 extends towards rail mounting portion 88.

FIG. 8 illustrates a flexible support structure 94 of the present invention having a thrusting L-shaped support 96 that is similar to thrusting L-shaped support shown in FIG. 7. Thrusting L-shaped support 96 includes a thrusting main vertical portion 98 connected by a lower connecting portion 100 to a horizontal support anchoring portion 102. Support anchoring portion 102 is anchored to a mounting mat 104 and horizontal surface 106 by two anchoring assemblies 108 which are each similar to the anchoring assembly shown in FIG. 1. Connected to and extending from the top of the thrusting main vertical portion 98 by an upper connecting portion 110 is a vertical rail mounting portion 112. A three peaked wave-shaped guard rail barrier 114 is mounted on rail mounting portion 112 by means of two conventional rail mounting assemblies 116 which are each similar to the rail mounting assembly of FIG. 1. In comparison to the guard rail barrier shown in FIG. 7, in order to accommodate the taller guard rail barrier 114 of flexible support structure 94, rail mounting portion 112 is taller and two mounting assemblies 116 are used to mount guard rail barrier 114. In flexible support structure 94, as shown in FIG. 8, main vertical portion 98 is a thrusting portion because main vertical portion 98 extends towards rail mounting portion 112.

FIG. 9 illustrates a flexible support structure 118 of the present invention having an inverted U-shaped flexible support 120. Inverted U-shaped support 120 includes a horizontal top portion 122 connected to two thrusting main vertical portions 124 by respective curved upper connecting portions 126. Each of two support anchoring portions 128 are connected to a respective one of the thrusting main vertical portions 124 by a respective curved lower connecting portion 129. The two support anchoring portions 128 are anchored to two mounting mats 130 and a horizontal surface 132 by two anchoring assemblies 134 which are similar to the anchoring assembly shown in FIG. 1. Each of two W-shaped guard rail barriers 136 is mounted on a respective one of the thrusting main vertical portions 124 by means of a conventional rail mounting assembly 138 which can be similar to the rail mounting assemblies of the guard rail barriers shown in FIGS. 7 and 8. In many ways, each side of flexible support structure 118 shown in FIG. 9 functions similarly to the flexible support structure shown in FIG. 7. In order to mount a larger guard rail barrier, such as the three peaked wave-shaped guard rail barrier shown in FIG. 8, a flat mounting portion (not shown) can be included between the top each of the main vertical portions and the respective upper curved connecting portions to accommodate the taller guard rail barrier and additional mounting assemblies in a fashion similar to the way that the taller rail mounting portion of FIG. 8 accommodates a taller guard rail barrier. Flexible support structure 118 may be used in locations where guard rail barriers are needed on both sides of a U-shaped flexible support such as on a median strip in the middle of a highway.

Figure 10:
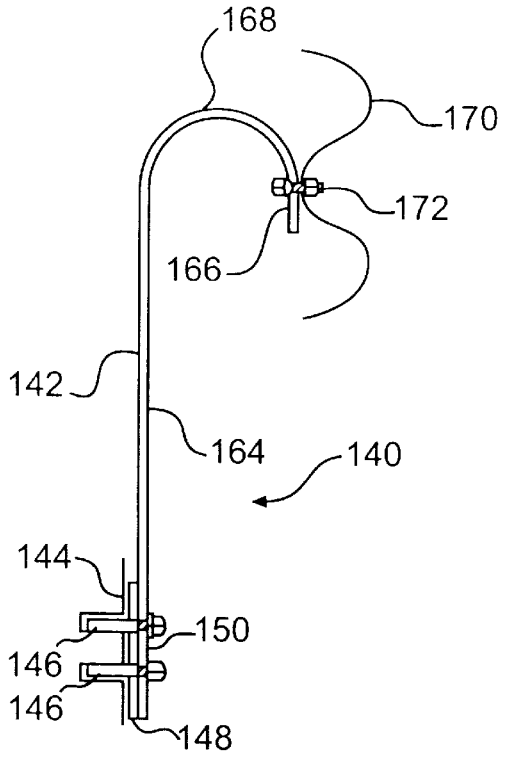
FIG. 10 is a cross-sectional side view of a another preferred embodiment of a flexible support and guard rail barrier of the present invention anchored to a vertical surface.
Figure 11:
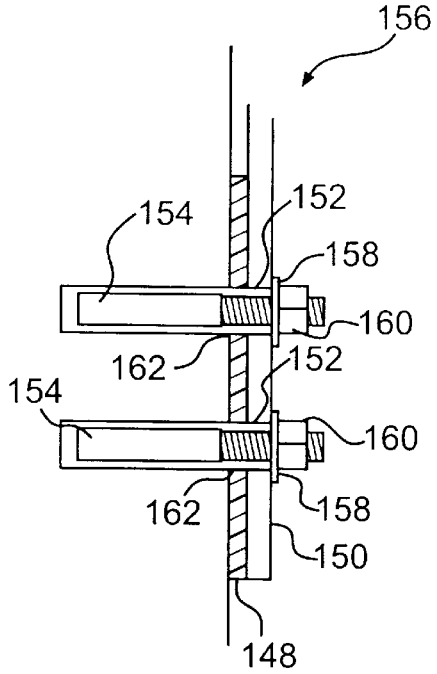
FIG. 11 is a cross-sectional view of part of the another preferred embodiment of the flexible support of FIG. 10 anchored to a vertical surface.

FIG. 10 illustrates a flexible support structure 140 of the present invention which includes an inverted J-shaped support 142 which is mounted on a vertical surface 144, such as a wall, by means of an anchoring assembly 146 and a mounting mat 148, which are shown in greater detail in FIG. 11. Support 142 of flexible support structure 140 includes a support anchoring portion 150 having a pair of openings 152 therein, through which screws 154 of a support anchoring assembly 156 are inserted. Anchoring assembly 156 also includes lock washers 158, and hexagonal nuts 160 for each of the respective screws 154. Mounting mat 148, which is similar to the mounting mat shown in FIG. 1, has two openings 162 through which screws 154 extend. Preferably, mounting mat 148 is made of a rubber or rubber-like material such as neoprene. In flexible support structure 140, support anchoring portion 150 is the lower part of a main vertical portion 164. A rail mounting portion 166 of support 142 is connected to main vertical portion 164 by a connecting portion 168 which is preferably curved. A guard rail barrier 170 having a W-shaped cross section is mounted on rail mounting portion 166 of support 142 using a conventional rail mounting assembly 172, such as the type used in the guard rail shown in FIG. 1.

Figure 12:
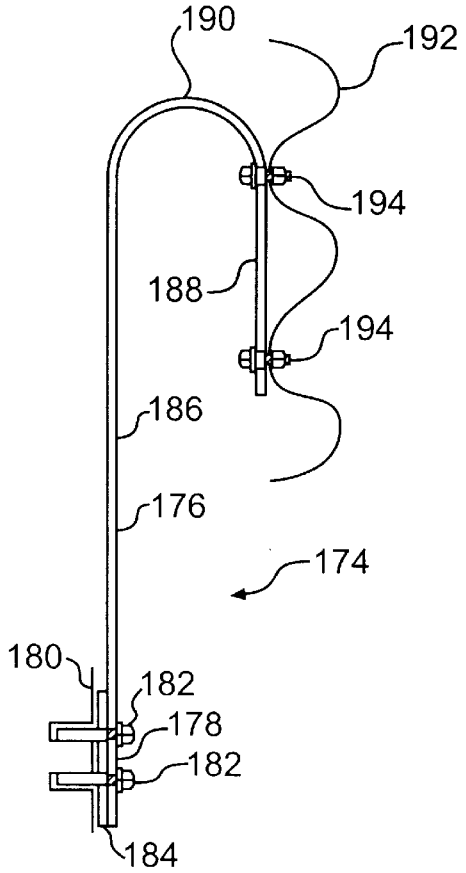
FIG. 12 is a cross-sectional side view of a another preferred embodiment of the flexible support and guard rail barrier of the present invention anchored to a vertical surface.

FIG. 12 illustrates a flexible support structure 174 of the present invention which includes an inverted J-shaped support 176. A support anchoring portion 178 of support 176 is mounted on a vertical surface 180 by means of an anchoring assembly 182 and a mounting mat 184, which are similar to the anchoring assembly and mounting mat shown in FIGS. 10 and 11. In flexible support structure 174, support anchoring portion 178 is the lower part of a main vertical portion 186. A rail mounting portion 188 of support 176 is connected to main vertical portion 186 by a connecting portion 190 which is preferably curved. A guard rail barrier 192 having a three peaked wave-shaped cross section is mounted on rail mounting portion 188 of support 176 using two conventional rail mounting assemblies 194, such as the type used in the guard rail barriers shown in FIGS. 1 and 10. Guard rail mounting portion 188 is longer than the guard rail mounting portion of the guard rail barrier of FIG. 10 in order to mount the taller guard rail 192 of flexible support structure 174 shown in FIG. 12.

The flexible support of the present invention may be made of any sturdy, flexible material such as thin strips of metal, plastic, metal reinforced plastic, etc. that provides sufficient flexibility and ductility for the purposes of the present invention. Preferably, the blank of material used to make the flexible support of the present invention has a thickness of 0.125 inches to 1 inch, a width of 2 to 8 inches, and a length of 24 inches to 144 inches. For a given section of guard rail barrier to be supported, there can be several flexible supports.

The guard rail barriers that can be installed in the flexible support of the present invention can be stiff like conventional guard rail barriers, or can be made of a more, flexible material such as thin strips of metal, plastic, metal reinforced plastic, rubber, metal reinforced rubber, etc. Because the load bearing requirements on the guard rail barriers are less than on the flexible support, the guard rails can be made of less sturdy materials than the flexible support.

In addition to being used to mount guard rail barriers, one or more flexible supports of the present invention may be used to support other structures such as a seat or a bench.

Although the present invention has been fully described in conjunction with the preferred embodiment thereof with reference to the accompanying drawings, it is to be understood that various changes and modifications may be apparent to those skilled in the art. Such changes and modifications are to be understood as included within the scope of the present invention as defined by the appended claims, unless they depart therefrom.

What is claimed:

1. A flexible support comprising:

at least one S-shaped support, having a longitudinal axis therethough said at least one S-shaped support including:

a substantially horizontal support anchoring portion for allowing said flexible support to be anchored to a horizontal surface, said horizontal support anchoring portion being located at a first free end of said flexible support;

a reclining portion connected to said support anchoring portion by a first connecting portion, said reclining portion extending in a substantially vertical direction and at a acute angle from said support anchoring portion; and a rail mounting portion for mounting a guard rail barrier on said flexible support, said rail mounting portion being connected to said reclining portion by a second connecting portion, said rail mounting portion extending in a substantially vertical direction, facing said reclining portion and being located at a second free end of said flexible support; wherein said longitudinal axis extends in a substantially vertical direction between said first and second connecting portions.

2. The flexible support of claim 1, wherein said first connecting portion is curved.

3. The flexible support of claim 1, wherein said second connecting portion is curved.

4. The flexible support of claim 1, further including means for mounting said horizontal support anchoring portion on a substantially horizontal surface.

5. The flexible support of claim 1, wherein said at least one S-shaped support is comprised of metal.

6. The flexible support of claim 1, further comprising a substantially horizontally extending guard rail barrier mounted on said rail mounting portion.

7. The flexible support of claim 6, wherein said at least one S-shaped support comprises at least two S-shaped supports.

8. The flexible support of claim 6, wherein said guard rail barrier has a W-shaped cross section.

9. The flexible support of claim 6, wherein said guard rail barrier has a three peaked wave-shaped cross section.

10. A flexible support comprising:

at least one thrusting L-shaped support, said at least one thrusting L-shaped support including:

a substantially horizontal support anchoring portion for allowing said flexible support to be anchored to a horizontal surface, said horizontal support anchoring portion being located at a first free end of said flexible support;

a thrusting portion connected to said support anchoring portion by a first connecting portion, said thrusting portion extending in a substantially vertical direction and at a acute angle from said support anchoring portion;

a rail mounting portion for mounting a guard rail barrier on said support, said rail mounting portion extending in a vertical direction from a top part of said thrusting portion, being connected to said thrusting portion by a second connecting portion, and being located at a second free end of said flexible support; and means for mounting said horizontal support anchoring portion on a substantially horizontal surface; wherein said mounting means extends through said horizontal support anchoring portion.

11. The flexible support of claim 10, wherein said first connecting portion and said second connecting portion are each curved.

12. The flexible support of claim 10, wherein said at least one thrusting L-shaped support is comprised of metal.

13. The flexible support of claim 10, further comprising a substantially horizontally extending guard rail barrier mounted on said rail mounting portion

14. The flexible support of claim 13, wherein said at least one thrusting L-shaped support comprises at least two thrusting L-shaped supports.

15. The flexible support of claim 13, wherein said guard rail barrier has a W-shaped cross section.

16. The flexible support of claim 13, wherein said guard rail barrier has a three peaked wave-shaped cross section.

17. A flexible support comprising:

at least one inverted U-shaped support, said at least one inverted U-shaped support including:

a substantially horizontal first support anchoring portion;

a first thrusting portion connected to said first support anchoring portion by a first lower connecting portion, said first thrusting portion extending at a acute angle from said first support anchoring portion;

a substantially horizontal second support anchoring portion;

a second thrusting portion connected to said second support anchoring portion by a second lower connecting portion, said second thrusting portion extending at a acute angle from said support anchoring portion, said second thrusting portion facing and reclining away from said first thrusting portion;

a first top part on said first thrusting portion for mounting a first guard rail barrier on said support;

a second top part on said second thrusting portion for mounting a second guard rail barrier on said support; and a top member connecting said first top part and said second top part.

18. The flexible support of claim 17 wherein said top member includes a curved first upper connecting portion connecting said top member to said first thrusting portion and a curved second upper connecting portion connecting said top member to said second thrusting portion.

19. The flexible support of claim 17, further including first mounting means for mounting said first horizontal support anchoring portion on a substantially horizontal surface and second mounting means for mounting said second horizontal support anchoring portion on said substantially horizontal surface.

20. The flexible support of claim 17, wherein said at least one inverted U-shaped support is comprised of metal.

21. The flexible support of claim 17, further comprising a substantially horizontally extending first guard rail barrier mounted on said first top part; and a substantially horizontally extending second guard rail barrier mounted on said second top part.

22. The flexible support of claim 21, wherein said at least one inverted U-shaped support comprises at least two inverted U-shaped supports.

23. The flexible support of claim 21 wherein each of said first and second guard rail barriers has a W-shaped cross section.

* * * * *